US007490410B2

(12) United States Patent
Ordaz

(10) Patent No.: US 7,490,410 B2
(45) Date of Patent: Feb. 17, 2009

(54) PIVOT PENCIL

(76) Inventor: Gregory R. Ordaz, 6509 Hyde Ave., Las Vegas, NV (US) 89107

( * ) Notice: Subject to any disclaimer, the term of this patent is extended or adjusted under 35 U.S.C. 154(b) by 0 days.

(21) Appl. No.: 11/395,842

(22) Filed: Apr. 3, 2006

(65) Prior Publication Data

US 2007/0245577 A1 Oct. 25, 2007

(51) Int. Cl.
*B43L 13/00* (2006.01)
*B43K 27/00* (2006.01)

(52) U.S. Cl. ..... 33/27.02; 33/18.2; 403/19; 403/34; 403/48

(58) Field of Classification Search ..... 33/27.02, 33/18.1, 18.2, 27.01, 27.04–27.09, 495–500; 401/19, 20, 34, 88, 89, 48, 52
See application file for complete search history.

(56) References Cited

U.S. PATENT DOCUMENTS 376,379 A * 1/1888 Hanower ..... 33/27.02
889,435 A * 6/1908 Bustanoby ..... 401/34
1,341,509 A * 5/1920 Klingele ..... 401/95
1,611,835 A * 12/1926 Keaney ..... 33/27.02
1,674,726 A * 6/1928 Keaney ..... 33/27.02
1,783,436 A * 12/1930 Kratochvil ..... 401/34
2,017,737 A * 10/1935 Smith ..... 33/27.02
2,074,102 A * 3/1937 Christy ..... 33/27.02
2,510,302 A * 6/1950 White ..... 401/34
2,563,309 A * 8/1951 Collins, Sr. ..... 33/27.01
4,549,827 A * 10/1985 Mack ..... 401/29
5,984,558 A * 11/1999 Diep ..... 401/195
6,386,777 B1 * 5/2002 Lee ..... 401/34
6,425,703 B1 * 7/2002 McDonnell et al. ..... 401/34
6,720,085 B2 * 4/2004 Ito et al. ..... 428/480

* cited by examiner

*Primary Examiner*—G. Bradley Bennett
*Assistant Examiner*—Amy Cohen Johnson
(74) *Attorney, Agent, or Firm*—Veronica-Adele R. Cao; Weiss & Moy, P.C.

(57) ABSTRACT

The "Pivot Pencil" is a writing instrument: carpenters pencil, mechanical pencil, pen, marking pen, etc; A Pivot Swivel Joint inserted into the center of the Wooden Outer Casing that "allows the tool to pivot in various angles", which allows the pencil access in tight spots and around corners. If you can't reach the surface you wish to mark, you might as well guess. But the "Pivot Pencil" can take away all the guesswork. The unique pivoting design is all the accuracy you need.

18 Claims, 4 Drawing Sheets

PIVOT PENCIL

DETAILED DESCRIPTION OF THE INVENTION

Figure 1:
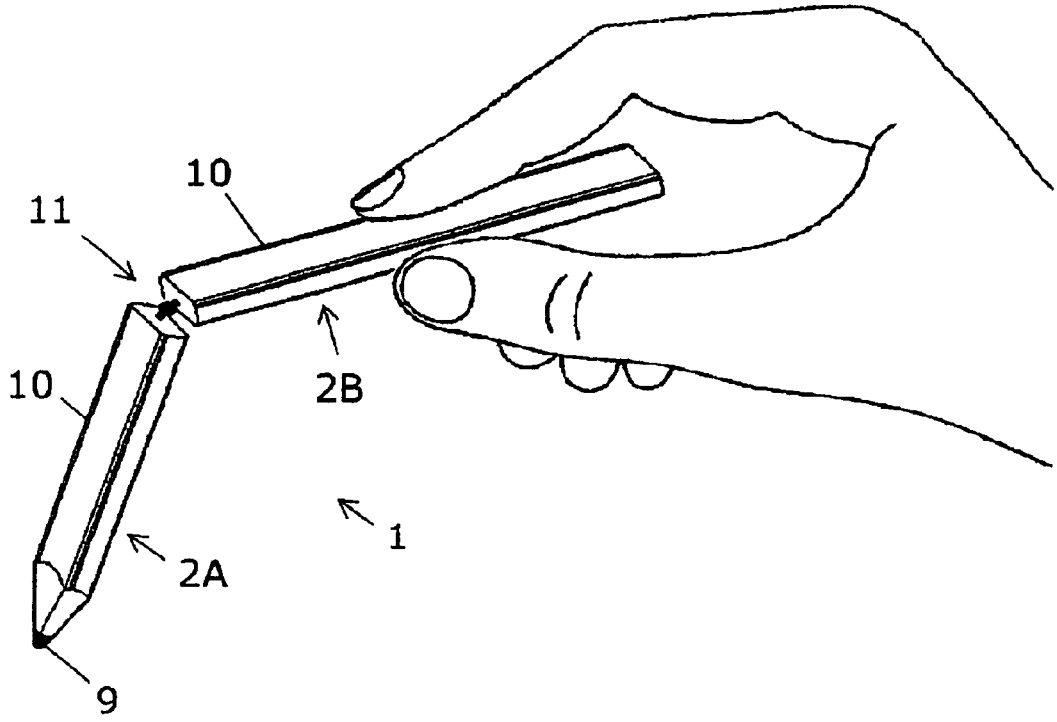
FIG. 1 is a perspective view showing the writing instrument and pivoting embodiment in use.
Figure 2:
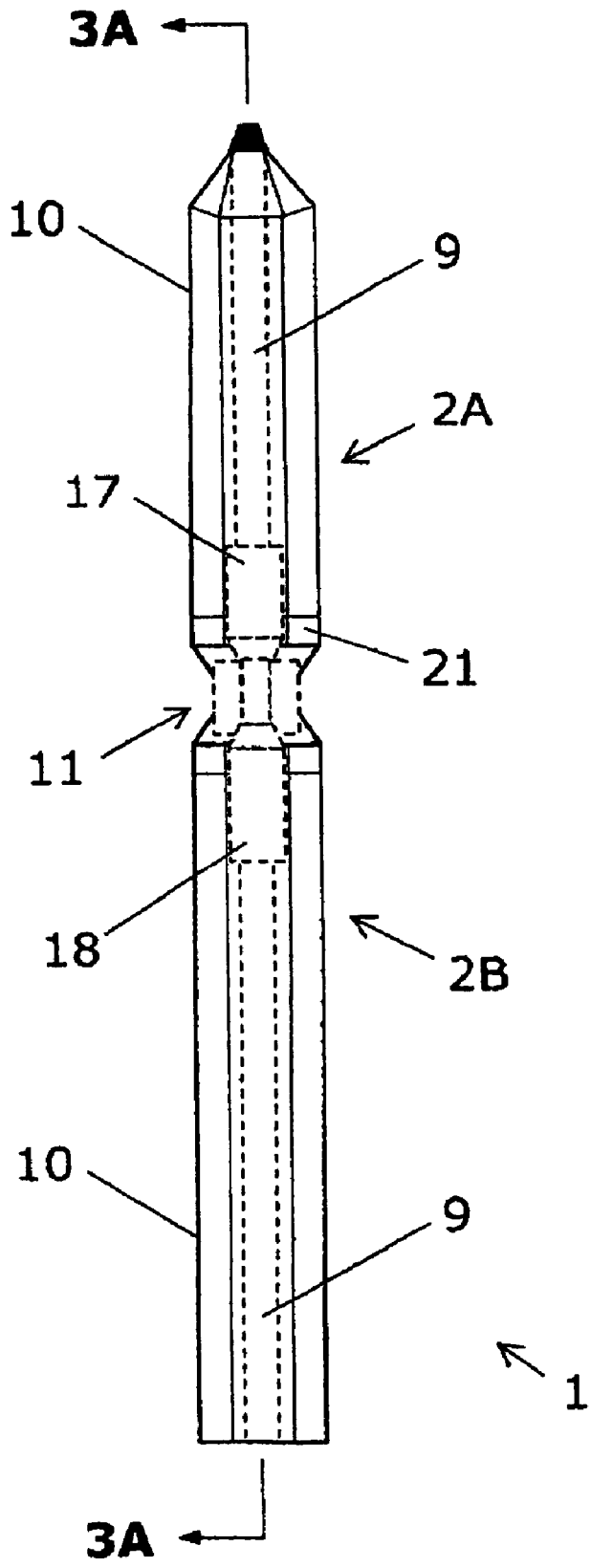
FIG. 2 is an orthogonal view of the top side of the writing instrument of FIG. 1.
Figure 3A:
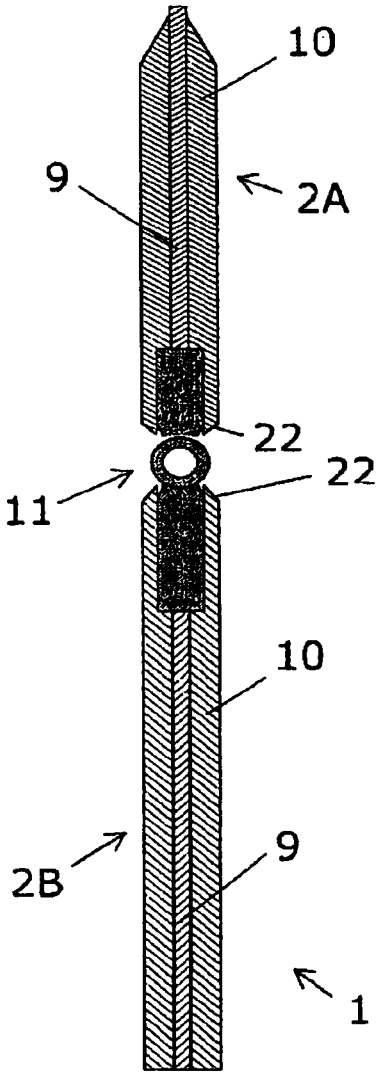
FIG. 3A is an orthogonal sectional view of FIG. 2 at the initial position.
Figure 3B:
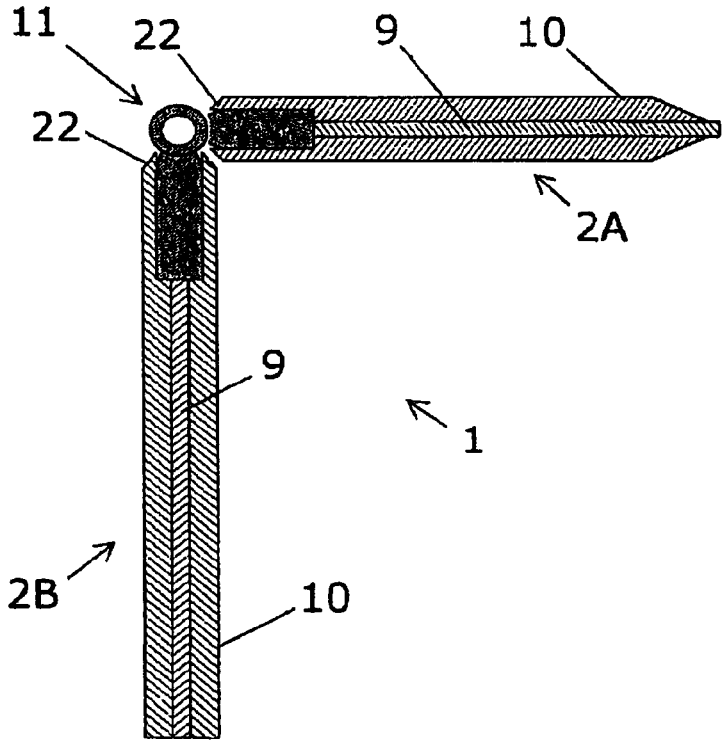
FIG. 3B is an orthogonal sectional view of FIG. 2 at a subsequent pivot position.
Figure 4:
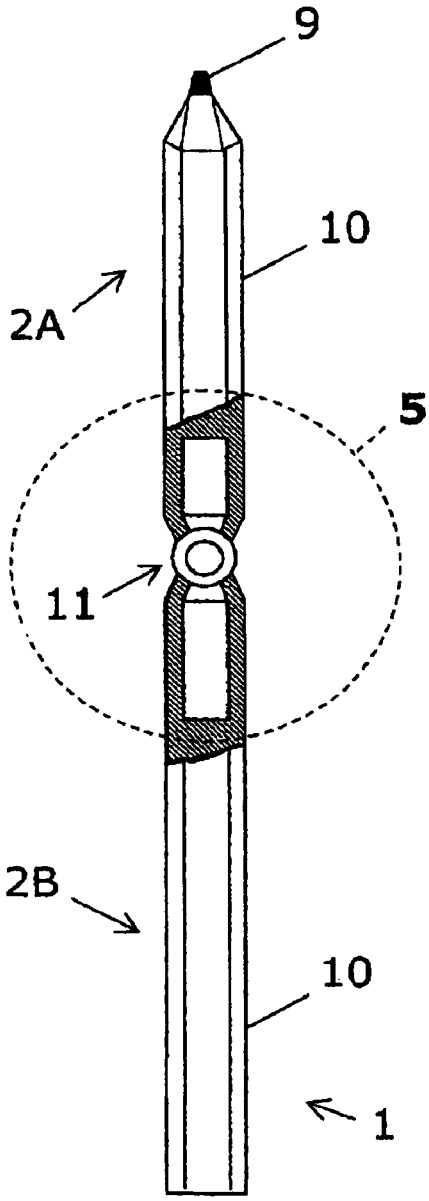
FIG. 4 is an orthogonal partial sectional view of the outer side of the writing instrument of FIG. 2.
Figure 5:
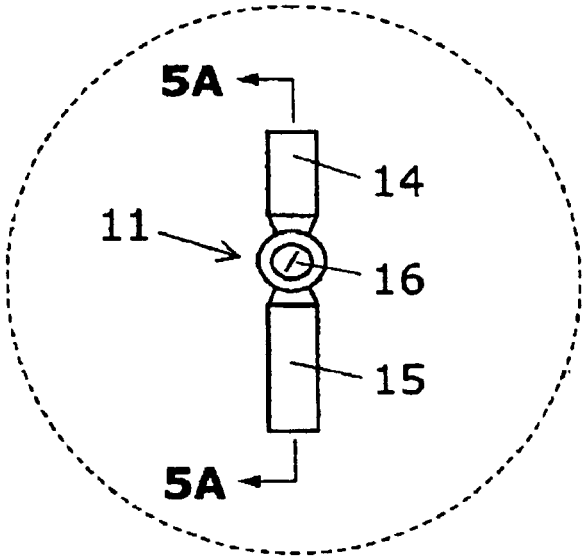
FIG. 5 is an orthogonal enlarged partial sectional view of FIG. 4.
Figure 5A:
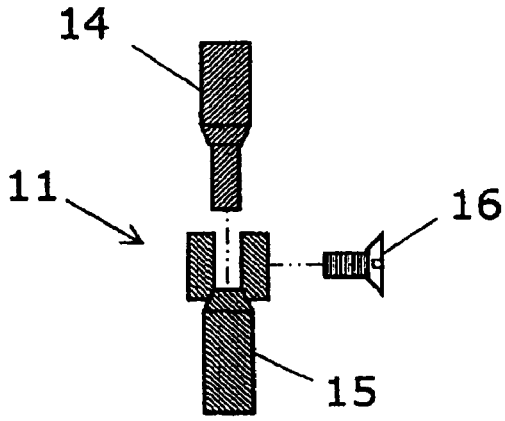
FIG. 5A is an orthogonal exploded view of FIG. 5.

Referring to FIGS. 1 and 2, a writing instrument 1, comprising (2) matching pencil segments 2A, 2B. The pencil segments 2A, 2B, of the embodiment are comprised of an elongated core-element marking means 9, having a length of 3.5 inches, a width 0.250 of an inch, and a thickness 0.062 of an inch, and a holder 10, surrounding and encasing the elongated core-element marking means 9, and having a length of 3.5 inches, a width 0.562 of an inch, and a thickness 0.312 of an inch. A swivel joint assembly 11 connects the segments 2A, 2B, of the writing instrument 1. The swivel joint assembly 11 is made from a high strength material such as steel, but can be made from a variety of other materials as required for strength purposes. Referring to FIGS. 4, 5, 5A, the female end 15, of the swivel joint assembly 11, has a shaft 0.187 of an inch in diameter on one end and a spherical ball shape 0.250 of an inch in diameter on the opposite end. The female end 15, measures 0.688 of an inch in total length. (2) tongs are cut out on the center line of the spherical ball shaped end parallel to the length of the shaft to form a fork like shape. Each tong is 0.083 of an inch in thickness with a 0.083 of an inch space between the tongs, and a depth of 0.250 of an inch. The male end 14, of the swivel joint assembly 11, has a shaft 0.187 of an inch in diameter on one end, and a spherical ball shape 0.250 of an inch in diameter on the opposite end, and measures 1.250 inches in total length. (1) tong is cut out on the center line of the spherical ball shaped end parallel to the length of the shaft. The tong is 0.08 of an inch in thickness and 0.250 of an inch in depth. A hole is drilled through the 0.250 inch diameter spherical part of the male 14, and female 15 of the swivel joint assembly 11, perpendicular to the longitude of the shaft and center line of the 0.250 diameter sphere, and then tapped. A screw 16 is mounted in the spherical center point of the swivel joint assembly 11, swivel ably connecting the female 15, and male 14. Referring to FIGS. 1 and 2, The elongated shaft of the female end 15 and the male end 14 of the swivel joint 11 are inserted into bores 17, and 18, of segments 2A, and 2B respectively, and positioned geometrically to where the pivot axis of the swivel joint assembly 11, is perpendicular to the longitude, and parallel to the width of segments 2A, 2B, then permanently secured by a bonding agent such as glue or epoxy (not shown). Referring to FIG. 3A, which shows a sectional view of the writing instrument 1, of FIG. 2 taken at the sectioning plane, and in the direction indicated by the section arrows 3A-3A. This sectional view shows the initial position of the writing instrument 1. Referring to FIG. 3B, the subsequent view of FIG. 3A, segment 2A, in a subsequent moved position. The attached segments 2A, 2B, are tapered to a 45 degree angle 22, to prevent interference with the swivel joint assembly 11. Referring to FIGS. 1-5A, the spherical center point of the swivel joint assembly 11, pivots allowing approximately 360 degree range of free movement of attached segments 2A, 2B, The swivel joint assembly 11, is encased in a single ply of heat shrink tubing 21, 0.500 of an inch in diameter, 1.125 inches in length, and 0.0625 of all inch thick. The writing instrument 1 can be made in a variety of configurations colors, sizes, and core-element marking means 9. Users can set the writing instrument 1 at a desired angle by pivoting one or both segments 2A, 2B, in order to reach within and mark upon surfaces as needed.

The invention claimed is:

1. A hand held writing instrument comprising: two identical elongated pencil segments attached independently to opposing lever ends of a mechanical pivot mechanism, having an axis of rotation vertical in relation to the longitudinal axis of the writing instrument, that can be used to access and mark within areas of restricted space, by adjusting the included angle between said segments from 45 to 270 degrees; wherein in a first end of segment one of said segments a hole is formed parallel to the longitudinal axis and coaxial in relation thereto, to attach one lever end of said mechanical pivot mechanism, wherein in a first end of segment two of said segments a hole is formed parallel to the longitudinal axis and coaxial in relation thereto to attach the opposite lever end of said mechanical pivot mechanism.

2. A hand held writing instrument as defined in claim 1 wherein said mechanical pivot mechanism comprising two elongated levers parallel and coaxial in relation to the longitudinal axis thereto, and are linked together at a fulcrum with a shoulder screw, where said shoulder screw provides resistance to maintain rigidity of said mechanical pivot mechanism, wherein in a first end of lever one of said levers a groove is formed perpendicular to the longitudinal axis thereto, and a threaded hole is formed perpendicular to the opposing sides of said groove and aligned with the longitudinal axis of lever one of said levers, wherein said hole is countersunk on an outer side of said lever one to accept said shoulder screw, wherein a first end of lever two of said levers is configured to fit within the grooved end of said lever one, wherein said first end of said lever two is joined with said first end of said lever one, a coaxial hole is formed through said first end of said lever two, wherein said first end of said lever one and first end of said lever two are joined together with said shoulder screw, where as said shoulder screw is the fulcrum of said mechanical pivot mechanism, having an axis perpendicular to the longitudinal axis of said levers.

3. A hand held writing instrument as defined in claim 2 wherein the first end of segment one of said segments is attached to a second end of lever one of said mechanical pivot mechanism and the first end of segment two of said segments is attached to a second end of lever two of said mechanical pivot mechanism, wherein said segments are opposite, facing and parallel thereto longitudinally and parallel to the longitudinal axis of said mechanical pivot mechanism, wherein a horizontal axis of said segments are parallel to the axis of said fulcrum, and said fulcrum having a direction of rotation vertical in relation to the longitudinal axis of the said writing instrument.

4. A writing instrument comprising:

a first pencil segment defining a bore formed parallel to and coaxial in relation to a longitudinal axis of the first pencil segment at one end;

a second pencil segment defining a bore formed parallel to and coaxial in relation to a longitudinal axis of the second pencil segment at one end;

a swivel joint having a first end inserted into the bore of the first pencil segment and having a second end inserted into the bore of the second pencil segment.

5. The writing instrument of claim 4 further comprising heat shrink tubing for encasing the swivel joint.

6. The writing instrument of claim 4 wherein the first pencil segment and the second pencil segment each comprise:

an elongated core element marking means having:

a length of approximately 3.5 inches;

a width of approximately 0.250 inch; and a thickness of approximately 0.062 inch;

a holder surrounding and encasing the elongated core element marking means, the holder having:

a length of approximately 3.5 inches;

a width of approximately 0.562 inch; and a thickness of approximately 0.312 inch.

7. The writing instrument of claim 6 wherein a pivot axis of the swivel joint is parallel to the width of the first pencil segment and the second pencil segment.

8. The writing instrument of claim 4 wherein the swivel joint comprises:

a female end; and a male end;

wherein each of the female end and the male end have:

a shaft for insertion into the bore of one of the first pencil segment and the second pencil segment; and a spherical ball-shaped end; and wherein the spherical ball-shaped end of the female end is coupled to the spherical ball-shaped end of the male end.

9. The writing instrument of claim 8 wherein the female end has a length of approximately 0.688 inch.

10. The writing instrument of claim 8 wherein the male end has a length of approximately 1.250 inches.

11. The writing instrument of claim 8 wherein the shaft of the male end and the shaft of the female end each has a diameter of approximately 0.187 inch.

12. The writing instrument of claim 8 wherein the spherical ball-shaped end of the male end and the spherical ball-shaped end of the female end each has a diameter of approximately 0.250 inch.

13. The writing instrument of claim 8 wherein the swivel joint comprises:

two tongs defined by the spherical hall-shaped end of the female end and parallel to the length of the shaft of the female end, each of the two tongs defining a hole; and one tong defined by the spherical ball-shaped end of the male end and parallel to the length of the shaft of the male end, the tong defining a hole;

wherein the tong of the male end mates with the two tongs of the female end and all of the holes of the tongs are aligned; and a screw inserted through the holes for coupling the female end to the male end.

14. The writing instrument of claim 13 wherein the two tongs of the female end each have a thickness of approximately 0.083 inch and a depth of approximately 0.250 inch and wherein the two tongs are positioned approximately 0.083 inch apart and wherein the one tong of the male end has a thickness of approximately 0.08 inch and is positioned between the two tongs of the female end.

15. A writing instrument comprising:

a first pencil segment;

a second pencil segment;

wherein each of the first pencil segment and the second pencil segment have:

an elongated core element marking means; and a holder surrounding and encasing the elongated core element marking means; and a bore formed parallel to and coaxial in relation to a longitudinal axis defined at one end;

a swivel joint comprising:

a female end; and a male end;

wherein each of the female end and the male end have:

a shaft for insertion into the bore of one of the first pencil segment and the second pencil segment; and a spherical ball-shaped end;

wherein the spherical ball-shaped end of the female end is coupled to the spherical ball-shaped end of the male end.

16. The writing instrument of claim 15 wherein the swivel joint comprises:

two tongs defined by the spherical ball-shaped end of the female end and parallel to the length of the shaft of the female end, each of the two tongs defining a hole; and one tong defined by the spherical ball-shaped end of the male end and parallel to the length of the shaft of the male end, the tong defining a hole;

wherein the tong of the male end is positioned between the two tongs of the female end and all of the holes of the tongs are aligned; and a screw inserted through the holes for coupling the female end to the male end.

17. The writing instrument of claim 15 wherein the shaft of the male end and the shaft of the female end each has a diameter of approximately 0.187 inch and wherein the bore of the first pencil segment and the bore of the second segment are each sized to receive and secure one of the shaft of the male end and the female end of the swivel joint.

18. The writing instrument of claim 15 wherein the elongated core element marking means of the first pencil segment and the second pencil segment each has:

a length of approximately 3.5 inches;

a width of approximately 0.250 inch; and a thickness of approximately 0.062 inch;

wherein the holder surrounding and encasing the elongated core element marking means of the first pencil segment and the second pencil segment each has:

a length of approximately 3.5 inches;

a width of approximately 0.562 inch; and a thickness of approximately 0.312 inch; and wherein the pivot axis of the swivel joint is parallel to the width of the first pencil segment and the width of the second pencil segment.

* * * * *